US006032303A

United States Patent [19]

Schmidt

[11] Patent Number: 6,032,303

[45] Date of Patent: Mar. 7, 2000

[54] TOILET OVERFLOW PREVENTION SYSTEM

[76] Inventor: Daniel R. Schmidt, 404 E. Douglas St. East, Buffalo, Minn. 55313

[21] Appl. No.: 09/195,827

[22] Filed: Nov. 19, 1998

[51] Int. Cl.[7] ..... E03D 11/02; E03D 5/09

[52] U.S. Cl. ..... 4/427; 4/324; 4/397; 4/400; 4/413; 4/415

[58] Field of Search ..... 4/427, 413, 415, 4/324, 325, 382, 405, 397, 399–401

[56] References Cited

U.S. PATENT DOCUMENTS 2,583,468 1/1952 Castellano ..... 4/427
2,737,665 3/1956 Moss ..... 4/427
4,240,167 12/1980 Gilliland ..... 4/324
4,856,140 8/1989 Visco et al. ..... 4/405

*Primary Examiner*—Henry J. Recla
*Assistant Examiner*—Tuan Nguyen

[57] ABSTRACT

A toilet bowl overflow prevention device is provided including a rigid interconnect member having a top end adapted for being pivotally connected to a knob assembly of a toilet assembly. The interconnect member is adapted for forcing a flush valve of the toilet assembly into sealed abutment with a drain aperture of the toilet assembly when the knob assembly is rotated in a direction opposite of that associated with removing the flush valve from engagement with the drain aperture.

8 Claims, 2 Drawing Sheets

TOILET OVERFLOW PREVENTION SYSTEM

BACKGROUND OF THE INVENTION

1. Field of the Invention

The present invention relates to toilet flushing assemblies and more particularly pertains to a new toilet overflow prevention system for forcing a flush valve in sealed abutment with an associated egress aperture in order to prevent toilet overflow.

2. Description of the Prior Art

The use of toilet flushing assemblies is known in the prior art. More specifically, toilet flushing assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,408,705; U.S. Pat. No. 5,392,470; U.S. Pat. No. 5,293,650; U.S. Pat. No. 5,191,662; U.S. Pat. No. 4,735,230; and U.S. Pat. Des. 347,881.

In these respects, the toilet overflow prevention system according to the present invention substantially departs from the conventional concepts and designs of the prior art, and in so doing provides an apparatus primarily developed for the purpose of forcing a flush valve in sealed abutment with an associated egress aperture in order to prevent toilet overflow.

SUMMARY OF THE INVENTION

In view of the foregoing disadvantages inherent in the known types of toilet flushing assemblies now present in the prior art, the present invention provides a new toilet overflow prevention system construction wherein the same can be utilized for forcing a flush valve in sealed abutment with an associated egress aperture in order to prevent toilet overflow.

The general purpose of the present invention, which will be described subsequently in greater detail, is to provide a new toilet overflow prevention system apparatus and method which has many of the advantages of the toilet flushing assemblies mentioned heretofore and many novel features that result in a new toilet overflow prevention system which is not anticipated, rendered obvious, suggested, or even implied by any of the prior art toilet flushing assemblies, either alone or in any combination thereof.

To attain this, the present invention generally is adapted for use with a toilet assembly having a bowl with a tank mounted thereon. The tank has a rectangular configuration defined by a bottom face mounted on the bowl. A peripheral side wall is integrally coupled to a periphery of the bottom face and extends upwardly therefrom. A drain aperture is formed in the bottom face of the tank. As shown in the Figures, a flush valve is provided having an outboard portion with an inverted frusto-conical configuration. Associated therewith is an inboard portion including a pair of arms pivotally coupled to a pivot rod. This pivot rod is in turn mounted on the bottom face of the tank with ends extending laterally beyond the arms of the inboard portion of the flush valve. Also included is a knob assembly having a swivel rod positioned within a bore formed in a front face of the tank of the toilet assembly. A knob is mounted on an outboard end of the swivel rod exterior of the tank with a disk-shaped knurled periphery. As shown in FIG. 2, a plurality of linearly aligned diametrically disposed bores are formed in an inboard end of the swivel rod. For maintaining the rod in rotating relationship with the peripheral side wall of the tank of the toilet assembly, a bracket is screwably fastened to a central extent of the swivel rod within the tank. A radially extending portion of the knob assembly is equipped with a T-shaped sleeve. This sleeve is defined by a first tube receiving the inboard end of the swivel rod with a set screw screwably mounted in a central extent thereof. The set screw serves for being received by one of the bores of the swivel rod. A second tube of the sleeve is adapted for receiving a first end of a linear extension which extends radially from the swivel rod of the knob assembly. A plurality of linearly aligned vertically disposed bores are formed in the linear extension for reasons that will soon become apparent. Next provided is a weighted pivoting assembly having a pair of linear side members. An interconnect is coupled between first ends of the side members for maintaining the same in parallel relationship. Mounted on a central extent of the interconnect is a weight. A pair of aligned inverted U-shaped cut outs are formed in a bottom edge of each of the side members. Ideally, the U-shaped cut outs are positioned between the first ends of the side members and a central extent thereof. In use, the U-shaped cut outs serve for pivotally resting on the ends of the pivot rod. Two pair of aligned bores are formed in each of the side members between second ends and the central extent thereof. As shown in FIG. 2, a pair of dowels each have ends positioned through the bores of the side members and are maintained therein via hair pins. Also included is an adjustable intermediate connector assembly including a cubical inboard portion with a horizontal bore for receiving the second end of the linear extension of the knob assembly. The cubical inboard portion is equipped with a top aperture adapted to receive a set screw which selectively engages one of the bores of the linear extension of the knob assembly. The adjustable intermediate connector assembly further includes a cubical first middle portion having a top face fixedly mounted to a bottom face of the inboard portion. Associated therewith is a cubical second middle portion with a pivot interconnect rotatably positioned within a through hole formed in the first and second middle portions with a bushing situated therebetween. See FIG. 5. A pair of hair pins maintain the pivot interconnect in place. With continuing reference to FIG. 5, the adjustable intermediate connector assembly is equipped with a cubical outboard portion having a vertical bore and a rivet mounted between the outboard portion and the second middle portion with a bushing positioned therebetween. The outboard portion of the adjustable intermediate connector assembly is thus adapted for rotating about a horizontal axis in perpendicular relationship with the pivot interconnect. Finally, a plunger mechanism includes a vertically oriented sleeve having a top end positioned within the vertical bore of the outboard portion of the intermediate connector assembly. A plurality of linearly aligned diametrically opposed bores are formed in the sleeve for receiving a set screw. Such set screw engages the outboard portion of the intermediate connector assembly for maintaining the sleeve in fixed relationship therewith. A bottom end of the sleeve is equipped with a tab extending radially therefrom with a hole formed therein. A chain has a top end with a hook for engaging the hole of the tab and a bottom end connected to the outboard portion of the flush valve of the toilet assembly. As shown in FIG. 3, the intermediate connector assembly serves for lifting the flush valve upon the rotation of the knob of the knob assembly in a first direction. The plunger mechanism further includes elongated plunger having a length greater than that of the sleeve. The plunger is slidably disposed within the sleeve. Further, the plunger has a bottom end rotatably mounted on an outboard one of the dowels of the weighted pivoting assembly. A plurality of diametrically disposed bores are formed in the plunger for receiving a stopper piece which extends from the plunger. In use, the sleeve abuts the stopper and forces the dowels of the weighted pivoting assembly against the flush valve in order to manually force the same in sealed abutment with the drain aperture of the toilet assembly, as shown in FIG. 4. This only occurs upon the rotation of the knob of the knob assembly in a second direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet overflow prevention system apparatus and method which has many of the advantages of the toilet flushing assemblies mentioned heretofore and many novel features that result in a new toilet overflow prevention system which is not anticipated, rendered obvious, suggested, or even implied by any of the prior art toilet flushing assemblies, either alone or in any combination thereof.

It is another object of the present invention to provide a new toilet overflow prevention system which may be easily and efficiently manufactured and marketed.

It is a further object of the present invention to provide a new toilet overflow prevention system which is of a durable and reliable construction.

An even further object of the present invention is to provide a new toilet overflow prevention system which is susceptible of a low cost of manufacture with regard to both materials and labor, and which accordingly is then susceptible of low prices of sale to the consuming public, thereby making such toilet overflow prevention system economically available to the buying public.

Still yet another object of the present invention is to provide a new toilet overflow prevention system which provides in the apparatuses and methods of the prior art some of the advantages thereof, while simultaneously overcoming some of the disadvantages normally associated therewith.

Still another object of the present invention is to provide a new toilet overflow prevention system for forcing a flush valve in sealed abutment with an associated egress aperture in order to prevent toilet overflow.

Even still another object of the present invention is to provide a new toilet overflow prevention system that includes a rigid interconnect member having a top end adapted for being pivotally connected to a knob assembly of a toilet assembly. The interconnect member is adapted for forcing a flush valve of the toilet assembly into sealed abutment with a drain aperture of the toilet assembly when the knob assembly is rotated in a direction opposite of that associated with removing the flush valve from engagement with the drain aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
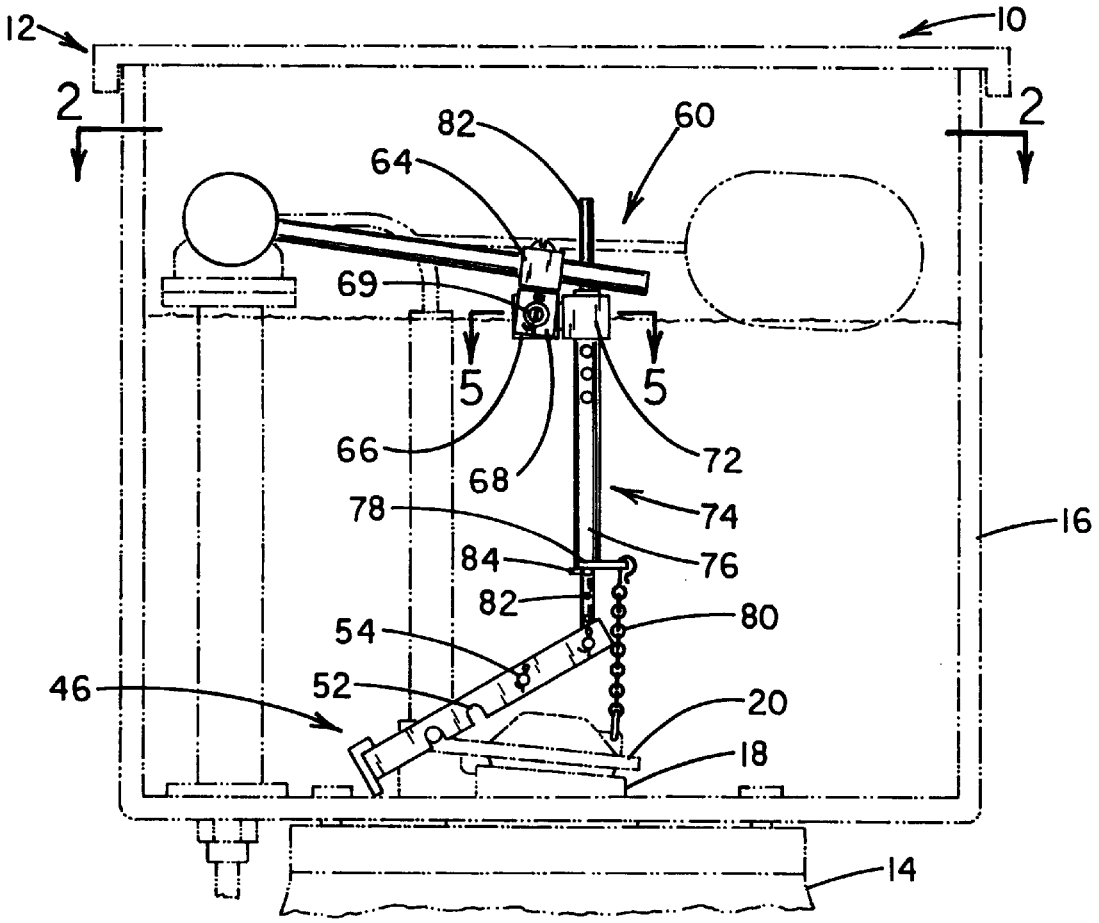
FIG. 1 is a front view of the present invention in a neutral position.

With reference now to the drawings, and in particular to FIGS. 1 through 5 thereof, a new toilet overflow prevention system embodying the principles and concepts of the present invention and generally designated by the reference numeral 10 will be described.

The present invention, designated as numeral 10, is adapted for use with a toilet assembly 12 having a bowl 14 with a tank 16 mounted thereon. The tank has a rectangular configuration defined by a bottom face mounted on the bowl. A peripheral side wall is integrally coupled to a periphery of the bottom face and extends upwardly therefrom. A drain aperture 18 is formed in the bottom face of the tank. As shown in the Figures, a flush valve 20 is provided having an outboard portion 22 with an inverted frusto-conical configuration. Associated therewith is an inboard portion 23 including a pair of arms pivotally coupled to a pivot rod. This pivot rod is in turn mounted on the bottom face of the tank with ends extending laterally beyond the arms of the inboard portion of the flush valve.

Figure 2:
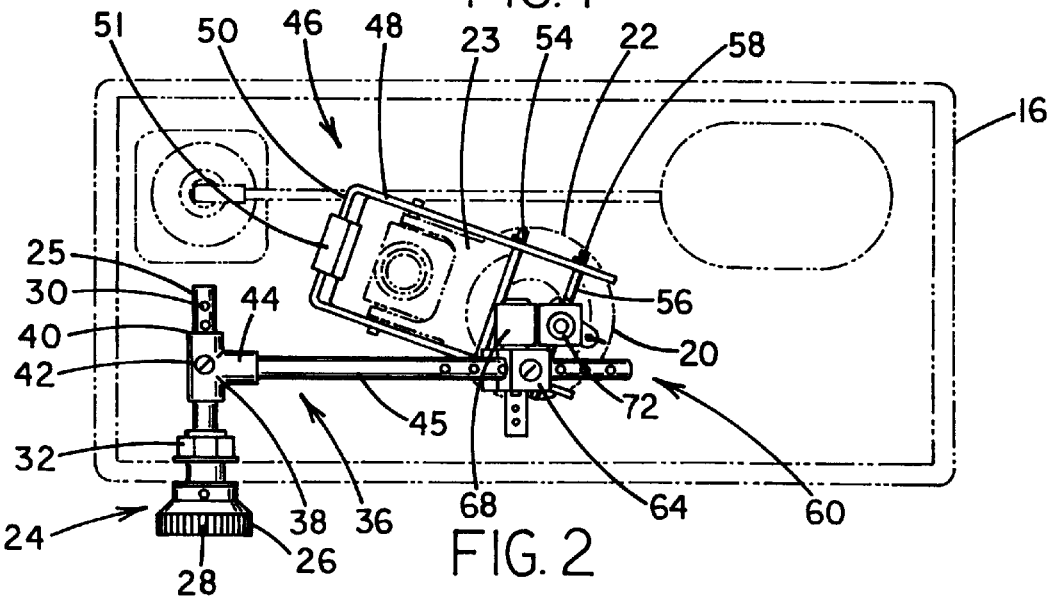
FIG. 2 is a top view of the present invention.

Also included is a knob assembly 24 having a swivel rod 25 positioned within a bore formed in a front face of the tank of the toilet assembly. A knob 26 is mounted on an outboard end of the swivel rod exterior of the tank with a disk-shaped knurled periphery 28. As shown in FIG. 2, a plurality of linearly aligned diametrically disposed bores 30 are formed in an inboard end of the swivel rod. For maintaining the rod in rotating relationship with the peripheral side wall of the tank of the toilet assembly, a bracket 32 is screwably fastened to a central extent of the swivel rod within the tank. A radially extending portion 36 of the knob assembly is equipped with a T-shaped sleeve 38. This sleeve is defined by a first tube 40 receiving the inboard end of the swivel rod with a set screw 42, or pin, mounted in a central extent thereof. The set screw serves for being received by one of the bores of the swivel rod. A second tube 44 of the T-shaped sleeve is adapted for receiving a first end of a linear extension 45 which extends radially from the swivel rod of the knob assembly. A plurality of linearly aligned, vertically disposed bores are formed in the linear extension for reasons that will soon become apparent.

Next provided is a weighted pivoting assembly 46 having a pair of linear side members 48. An interconnect 50 is coupled between first ends of the side members for maintaining the same in parallel relationship. Mounted on a central extent of the interconnect is a weight 51. A pair of aligned inverted U-shaped cut outs 52 are formed in a bottom edge of each of the side members. Ideally, the U-shaped cut outs are positioned between the first ends of the side members and a central extent thereof. In use, the U-shaped cut outs serve for pivotally resting on the ends of the pivot rod.

Two pair of aligned bores 54 are formed in each of the side members between second ends and the central extent thereof. As shown in FIG. 2, a pair of dowels 56 each have ends positioned through the bores of the side members and are maintained therein via hair pins 58.

Also included is an adjustable intermediate connector assembly 60 including a cubical inboard portion 64 with a horizontal bore for receiving the second end of the linear extension of the knob assembly. The cubical inboard portion is equipped with a top aperture adapted to receive a set screw or pin which selectively engages one of the bores of the linear extension of the knob assembly. The adjustable intermediate connector assembly further includes a cubical first middle portion 66 having a top face fixedly mounted to a bottom face of the inboard portion. Associated therewith is a cubical second middle portion 68 with a pivot interconnect 69 rotatably positioned within a through hole formed in the first and second middle portions with a bushing 70 situated therebetween. The inboard portion and the first middle portion are thus in side-by-side relationship. See FIG. 5. A pair of hair pins maintain the pivot interconnect in place. As an option, the pivot interconnect may take the form of a bolt or the like in order for allowing the portions to be tightened and loosened.

Figure 5:
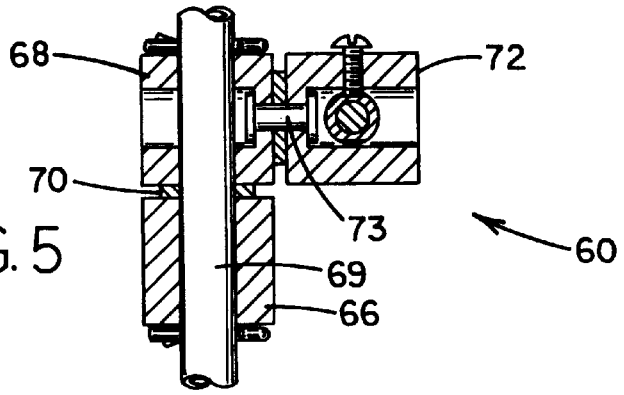
FIG. 5 is a cross-sectional view of the intermediate connector assembly of the present invention taken along line 5—5 shown in FIG. 1.

With continuing reference to FIG. 5, the adjustable intermediate connector assembly is equipped with a cubical outboard portion 72 having a vertical bore and a rivet 73 mounted between the outboard portion and the second middle portion with a bushing positioned therebetween. The outboard portion of the adjustable intermediate connector assembly is thus adapted for rotating about a horizontal axis in perpendicular relationship with the pivot interconnect. Similar to the pivot interconnect, the rivet may comprise a pair of threadedly coupled portions which may be selectively tightened or loosened.

Figure 3:
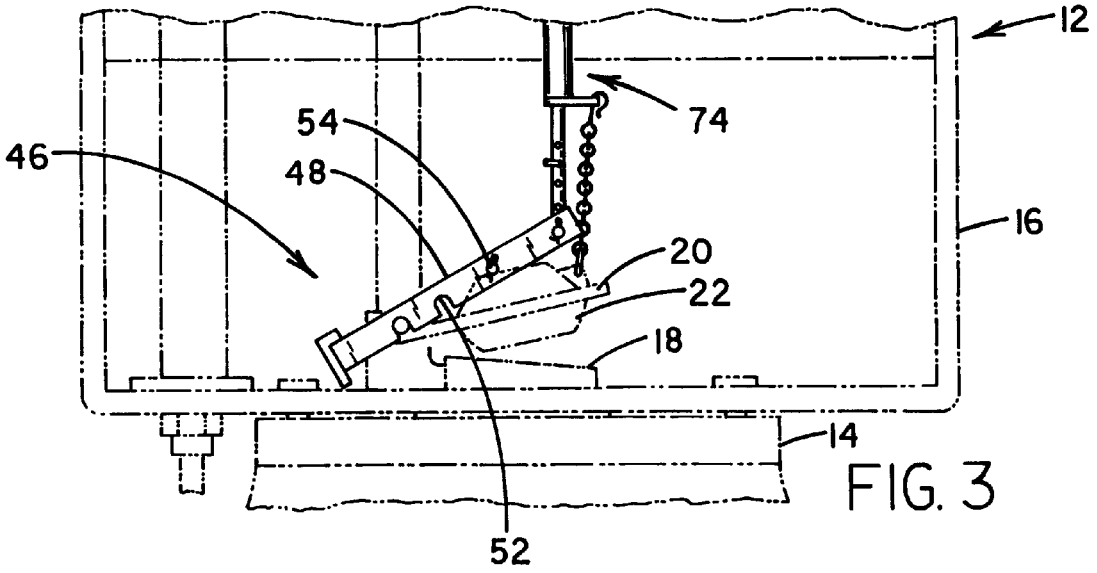
FIG. 3 is a front view of the present invention with the flush valve in an elevated orientation.

Finally, a plunger mechanism 74 includes a vertically oriented sleeve 76 having a top end positioned within the vertical bore of the outboard portion of the intermediate connector assembly. A plurality of linearly aligned diametrically opposed bores are formed in the sleeve for receiving a set screw or pin. Such set screw engages the outboard portion of the intermediate connector assembly for maintaining the sleeve in fixed relationship therewith. A bottom end of the sleeve is equipped with a tab 78 extending radially therefrom with a hole formed therein. A chain 80 has a top end with a hook for engaging the hole of the tab and a bottom end connected to the outboard portion of the flush valve of the toilet assembly. As shown in FIG. 3, the intermediate connector assembly serves for lifting the flush valve upon the rotation of the knob of the knob assembly in a first direction.

Figure 4:
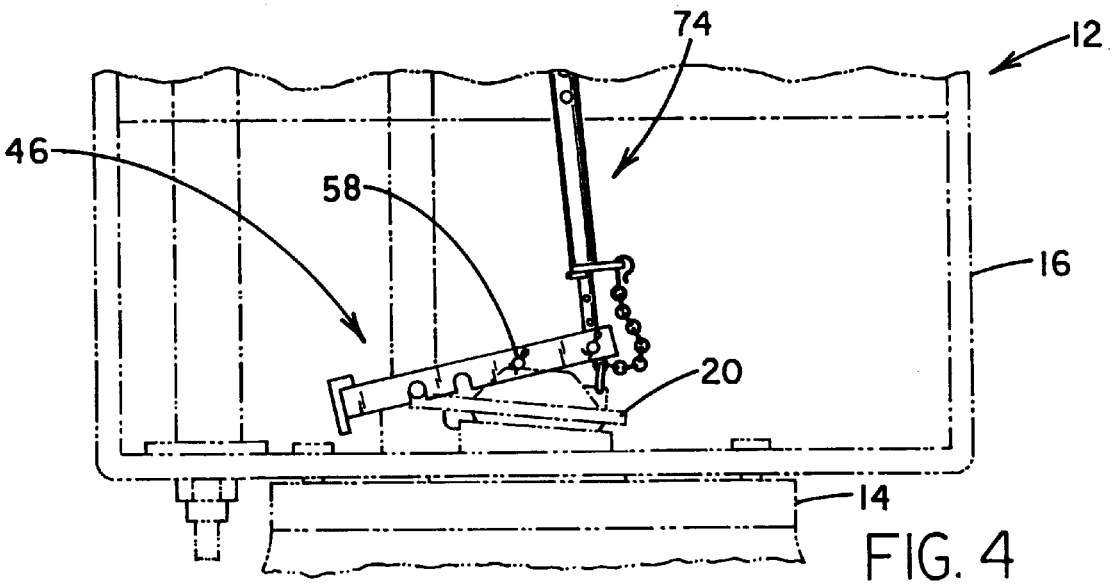
FIG. 4 is a front view of the present invention with the flush valve being forced downwardly.

The plunger mechanism further includes elongated plunger 82 having a length greater than that of the sleeve of the plunger mechanism. The plunger is slidably disposed within the sleeve during use. Further, the plunger has a bottom end rotatably mounted on an outboard one of the dowels of the weighted pivoting assembly. A plurality of diametrically disposed bores are formed in the plunger for receiving a stopper 84 piece which extends from the plunger. In use, the sleeve abuts the stopper and forces the dowels of the weighted pivoting assembly against the flush valve in order to manually force the same in sealed abutment with the drain aperture of the toilet assembly, as shown in FIG. 4. This only occurs upon the rotation of the knob of the knob assembly in a second direction. As such, a user may conveniently force the flush valve in sealed abutment with the drain aperture when desired to avoid toilet overflow.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet bowl overflow prevention system comprising, in combination:

a toilet assembly including a bowl having a tank mounted thereon with a rectangular configuration defined by a bottom face mounted on the bowl and a peripheral side wall mounted to a periphery of the bottom face and extending upwardly therefrom, a drain aperture formed in the bottom face of the tank, a flush valve having an outboard portion with an inverted frusto-conical configuration and an inboard portion including a pair of arms pivotally coupled to a pivot rod which is mounted on the bottom face of the tank with ends extending laterally beyond the arms of the inboard portion of the flush valve;

a knob assembly including a swivel rod positioned within a bore formed in a front face of the tank of the toilet assembly adjacent to an upper peripheral edge thereof, a knob mounted on an outboard end of the swivel rod exterior of the tank with a disk-shaped knurled periphery, a plurality of linearly aligned diametrically disposed bores formed in an inboard end of the swivel rod, a bracket screwably fastened to a central extent of the swivel rod within the tank for maintaining the rod in rotating relationship with the peripheral side wall of the tank of the toilet assembly, and a radially extending portion with a T-shaped sleeve defined by a first tube receiving the inboard end of the swivel rod with a set screw screwably mounted in a central extent thereof for being received by one of the bores of the swivel rod and a second tube for receiving a first end of a linear extension which extends radially from the swivel rod of the knob assembly with a plurality of linearly aligned vertically disposed bores formed therein;

a weighted pivoting assembly including a pair of linear side members, an interconnect coupled between first ends of the side members for maintaining the same in parallel relationship, a weight mounted on a central extent of the interconnect, a pair of aligned inverted U-shaped cut outs formed in a bottom edge of each of the side members between the first ends of the side members and a central extent thereof for pivotally resting on the ends of the pivot rod, two pair of aligned bores formed in each of the side members between second ends and the central extent thereof, and a pair of dowels each having ends positioned through the bores of the side members and maintained therein via hair pins coupled to ends of the dowels;

an adjustable intermediate connector assembly having a cubical inboard portion with a horizontal bore for receiving the second end of the linear extension of the knob assembly and having a top aperture adapted to receive a set screw which selectively engages one of the bores of the linear extension of the knob assembly, a cubical first middle portion having a top face fixedly mounted to a bottom face of the inboard portion, a cubical second middle portion with a pivot interconnect rotatably positioned within a through hole formed in the first and second middle portions with a bushing situated therebetween and a pair of hair pins maintaining the pivot interconnect in place, and a cubical outboard portion with a vertical bore and a rivet mounted between the outboard portion and the second middle portion with a bushing positioned therebetween for allowing the rotation thereof about a horizontal axis in perpendicular relationship with the pivot interconnect;

a plunger mechanism including a vertically oriented sleeve having a top end positioned within the vertical bore of the outboard portion of the intermediate connector assembly with a plurality of linearly aligned diametrically opposed bores for receiving a set screw engaged with the outboard portion of the intermediate connector assembly and a bottom end with a tab extending radially therefrom having a hole formed therein, a chain having a top end with a hook for engaging the hole of the tab and a bottom end connected to the outboard portion of the flush valve of the toilet assembly for lifting the same upon the rotation of the knob of the knob assembly in a first direction, an elongated plunger having a length greater than that of the sleeve slidably disposed within the sleeve and having a bottom end rotatably mounted on an outboard one of the dowels of the weighted pivoting assembly and having a plurality of diametrically disposed bores for receiving a stopper piece which extends from the plunger such that the sleeve abuts the same and forces the dowels of the weighted pivoting assembly against the flush valve in order to manually force the same in sealed abutment with the drain aperture of the toilet assembly upon the rotation of the knob of the knob assembly in a second direction.

2. A toilet bowl overflow prevention device comprising:

a rigid interconnect member having a top end adapted for being pivotally connected to a knob assembly of a toilet assembly for forcing a flush valve of the toilet assembly into sealed abutment with a drain aperture of the toilet assembly when the knob assembly is rotated in a direction opposite of that associated with removing the flush valve from engagement with the drain aperture; and a pivoting assembly adapted to be pivotally mounted within a tank of the toilet assembly, the pivoting assembly pivotally coupled to the interconnect member for engaging the flush valve when the knob assembly is rotated in a direction opposite of that associated with removing the flush valve from engagement with the drain aperture;

wherein the pivoting assembly and the flush valve pivot about a common axis.

3. A toilet bowl overflow prevention device as set forth in claim 2 wherein the interconnect member is a plunger adapted to lengthen when the knob assembly is rotated in the direction associated with removing the flush valve from engagement with the drain aperture.

4. A toilet bowl overflow prevention device as set forth in claim 2 wherein the pivoting assembly has a weight attached thereto.

5. A toilet bowl overflow prevention device comprising:

a rigid interconnect member having a top end adapted for being pivotally connected to a knob assembly of a toilet assembly for forcing a flush valve of the toilet assembly into sealed abutment with a drain aperture of the toilet assembly when the knob assembly is rotated in a direction opposite of that associated with removing the flush valve from engagement engagement with the drain aperture;

wherein the interconnect meniber is a plunger adapted to lengthen when the knob assembly is rotated in the direction associated with removing the flush valve from engagement with the drain aperture; and wherein the plunger has a plurality of apertures adapted to receive a stopper which limits an extent to which a length of the plunger may be minimized.

6. A toilet bowl overflow prevention device as set forth in claim 5 and further including a pivoting assembly adapted to be pivotally mounted within a tank of the toilet assembly, the pivoting assembly pivotally coupled to the interconnect member for engaging the flush valve when the knob assembly is rotated in a direction opposite of that associated with removing the flush valve from engagement with the drain aperture.

7. A toilet bowl overflow prevention device as set forth in claim 3 wherein the pivoting assembly has a weight attached thereto.

8. A toilet bowl overflow prevention device as set forth in claim 3 wherein the pivoting assembly and the flush valve pivot about a common axis.

* * * * *